United States Patent [19]

Linne

[11] 4,106,319

[45] Aug. 15, 1978

[54] APPARATUS FOR HOT-ROLLING NON-FERROUS METALS

[75] Inventor: Robert Steven Linne, Carrollton, Ga.

[73] Assignee: Southwire Company, Carrollton, Ga.

[21] Appl. No.: 776,796

[22] Filed: Mar. 11, 1977

[51] Int. Cl.[2] ..... B21B 1/00

[52] U.S. Cl. ..... 72/234; 72/366

[58] Field of Search ..... 72/234, 199, 365, 366; 148/31.5, 6.35; 29/132

[56] References Cited

U.S. PATENT DOCUMENTS

| | | | |
|---|---|---|---|
| 3,342,058 | 9/1967 | Nemoto et al. | 72/365 |
| 3,698,938 | 10/1972 | Mayhew | 148/6.35 X |
| 3,974,555 | 8/1976 | Strohmeier et al. | 29/132 |

*Primary Examiner*—Milton S. Mehr

*Attorney, Agent, or Firm*—Herbert M. Hanegan; Stanley L. Tate; Robert S. Linne

[57] ABSTRACT

A method of and apparatus for hot-rolling non-ferrous metal bar in a plural stage rolling mill are disclosed. Each stage of the rolling mill is provided with a plurality of work rolls which have a predetermined hardness and toughness depending on their intended use in the rolling mill to improve the uniformity of the useful life of the rolls among the various stages of the mill. A method of heat treating the work rolls and an improved forged steel work roll are also disclosed. The steel used to make the rolls is a forged chromium-molybdenum alloy steel having a chromium content in the range of 4.0 to 6.0 percent. The heat treatment process provides the working surfaces of the rolls with a dense, tightly-adhering oxide layer to protect the rolls from the high temperatures and pressures encountered during the hot-rolling operation.

8 Claims, No Drawings

APPARATUS FOR HOT-ROLLING NON-FERROUS METALS

BACKGROUND OF THE INVENTION

This invention relates to a method and apparatus for rolling hot continuously cast copper and aluminum bar. More particularly, the invention relates to a method of heat treating alloy steel work rolls of a plural stage rolling mill to prolong the useful life of the rolls and to improve the uniformity of useful life among the various roll stages. The invention also relates to improved work rolls and to a rolling mill which utilizes improved work rolls produced according to the heat treatment method of the invention.

In a conventional rolling mill, such as, for example, a Morgan Mill manufactured by Morgan Construction Co. of Worcester, Massachusetts, a continuously cast bar of non-ferrous metal is subjected to several stages of reduction, each reduction stage comprising a plurality of roll sets or stands. The roll stands are generally characterized according to their function in the rolling mill, for example, the roll stands arranged for receiving the hot continuously cast bar and for the initial reduction and working of the bar are identified as breakdown stands. Following the breakdown roll stands are intermediate roll stands sufficient in number to achieve the desired gradual reduction of the cast bar cross-section and, finally, the finishing roll stands which, in addition to some further reduction of the cast bar cross-section, are intended to provide the surfaces of the cast bar with a smooth surface for subsequent working operations, such as extrusion or drawing through dies to make wire.

In rolling mills of the aforementioned type for rolling continuously cast hot non-ferrous metals, it is known to use alloy steel work rolls to shape the metal bar. The alloy steel material from which the work rolls are fabricated must be capable of resisting the high temperatures and pressures associated with the rolling of such bars. A search of the prior art revealed that tool steels from which are fabricated work rolls used for hot-working ferrous metals usually have a substantially chromium content (13.0 to 20.0 percent by weight) and generally are characterized by high hardness and good wear resistance. The patents uncovered during the aforementioned search are listed below:

U.S. Pat. No. 2,197,098;
U.S. Pat. No. 2,442,223;
U.S. Pat. No. 3,576,782;
U.S. Pat. No. 3,097,091;
U.S. Pat. No. 3,421,307;
U.S. Pat. No. 3,496,031;
U.S. Pat. No. 3,885,995.

SUMMARY AND OBJECTS OF THE INVENTION

It is a primary object of this invention to provide a method of and apparatus for hot-rolling non-ferrous metals utilizing a plural stage rolling mill comprising work rolls having predetermined physical characteristics for improving the uniformity of useful life among the work rolls of the mill and for prolonging the useful life of the work rolls.

More particularly, it is an object of this invention to provide a plural stage hot-rolling mill and method for hot-rolling non-ferrous metals utilizing breakdown, intermediate and finishing rolls having predetermined hardness characteristics in a predetermined relation to one another.

Still more particularly, it is an object of this invention to provide a plural stage rolling mill including successively arranged breakdown, intermediate and finishing roll stages wherein the hardness of the rolls of one stage is less than the hardness of the rolls of a next succeeding stage.

It is another object of this invention to provide a method of making alloy steel work rolls for hot-rolling non-ferrous metals in a plural stage rolling mill to produce work rolls having a more uniform and longer average life throughout the mill.

Yet another object of this invention is to provide work rolls for a plural stage rolling mill for hot-rolling non-ferrous metals, which work rolls are subjected to a heat treatment process according to their function in the rolling mill.

It is another important object of this invention to provide improved work rolls for use in hot-rolling non-ferrous metals in a plural stage rolling mill wherein the rolls are heat treated to provide them with a predetermined surface hardness depending on the rolling conditions at their locations in the rolling mill.

Another object of this invention is to provide a method of heat treating alloy steel work rolls for hot-rolling non-ferrous metals to produce, on the working surfaces of the rolls, a dense, tightly-adhering oxide layer which serves to improve the wear resistance and, thus, the useful life of the work rolls.

Another object of this invention is to provide improved work rolls for hot-rolling non-ferrous metals which are formed of a low-alloy chromium-molybdenum steel having a relatively low chromium content.

Yet another object of this invention is to provide improved work rolls especially for use in hot-working non-ferrous continuously cast metals, such as aluminum and copper and alloys thereof.

It will be appreciated by those skilled in the art that the velocity of the cast bar significantly increases as it travels from the first breakdown roll stand to the final finishing roll stand. Typically, a bar of copper metal issues from a continuous casting machine and enters the first breakdown roll stand at a velocity of between 40 and 50 feet per minute and has a surface temperature of about 1500° F. Exit velocity of the rolled bar from the last finishing roll stand may be as high as 2,000 feet per minute at a surface temperature of about 1000° F. By collecting and analyzing work roll average life data it was discovered that the average life before rework or replacement of the work rolls of both the breakdown roll stands and the finishing roll stands is substantially less than the average life of the work rolls of the intermediate stands. Average roll life for the purposes of this discussion is defined in terms of tons of metal rolled per use and is determined for each roll stand by dividing the tons of metal produced over a given time period by the number of times the rolls of a stand are replaced during such time period. The roll life data has shown that, in some cases, the average life of intermediate rolls is as much as ten times that of finishing rolls and five times that of breakdown rolls. Such disparity in average roll life disadvantageously results in more frequent shutdown of the mill for roll replacement.

The aforedescribed phenomenon is believed to be due, at least in part, to the higher temperatures of the cast bar entering the rolling mill breakdown stands and to the greater velocity of the cast bar in the finishing roll stands as explained in greater detail hereinbelow. The higher temperature to which the breakdown rolls are subjected increases their susceptibility to thermal stress and fatigue and consequent thermal cracking. Moreover, the lower velocity of the bar in the breakdown roll stands means that the time than an incremental portion of the breakdown roll surface contacts the higher temperature bar during one revolution of the roll is relatively greater than for rolls of the same diameter traveling at a greater velocity, e.g., the intermediate and finishing rolls. In the finishing roll stands, on the other hand, while the temperature of the cast bar is substantially lower, the velocity of the bar is between about 40 and 50 times that in the breakdown roll stands. In addition, for a typical slippage between the bar and the work roll of about 5 to 10 percent at the aforementioned bar velocities, the relative speed between the finishing rolls and the bar may be as high as 100 to 200 feet per minute. Thus, it has been concluded that abrasive wear has a more significant impact on average life of the higher velocity finishing rolls than on the average life of either the breakdown or intermediate rolls.

A principal disadvantage associated with conventional work rolls for rolling hot non-ferrous metals is the relatively short average life of the rolls of the mill as a whole, that is, the sum of the average lives of all the mill stands divided by the number of stands. Even if the above-described disparity between average roll life of the various stands of a rolling mill were substantially reduced or eliminated by improving the average life of the breakdown and finishing rolls, it would still be desirable to further increase the average life of all the rolls of the mill and thereby still further reduce the frequency of mill shut-down.

In the conventional mills for the rolling of hot non-ferrous metals, the usual processing of the work rolls has included an initial rough machining of the rolls to obtain the desired size and shape. Thereafter, all the rolls of the mill were heat treated in a specified manner to improve the strength, hardness and wear resistance and, finally, ground and polished to provide a smooth, fine finish on the rolls. One reason for the final polishing step, particularly for the rolls of the finishing stands, was to provide the hot-rolled non-ferrous bar with a smooth finish corresponding to the finish on the work rolls. This processing of the work rolls to provide a smooth finish requires that, during heat treatment, the roll surfaces be protected from oxidation to as great an extent as possible, either by controlling the heat treatment furnace atmosphere, by heat treating in a vacuum, by wrapping the roll surfaces in a steel foil or other methods. Heat treating in the aforementioned manner will not, however, always insure that no oxidation of the roll surfaces will occur so that a subsequent grinding or polishing is generally required. Thus, the cost of processing the work rolls in this manner is considerable, often requiring the use of special heat treating and grinding/polishing equipment. Another problem associated with the smooth-finish work rolls of the prior art is the difficulty in starting up the rolling mill because of excessive slippage between the highly polished rolls and the cast bar.

Based on the foregoing analysis, the work rolls according to the invention are fabricated from a forged chromium-molybdenum hot-worked die steel with a high hardenability, such as AISI H-13 (ASM 521) steel or other low alloy steel having a chromium content of from about 4.0 to about 6.0 percent by weight and preferably from about 5.0 to about 5.5 percent by weight. Forged hollow bars of the steel roll material are machined to their final work shape and diameter. A controlled heat treatment process is then utilized to adapt the rolls for use in a plural stage rolling mill as breakdown rolls, intermediate rolls or as finishing rolls. Initially, the machined rolls are preheated to a temperature of about 1400° F and are thereafter loaded into a controlled atmosphere furnace and hardened by heating them to a temperature of between about 1875° F and 1975° F, and preferably about 1925° F. After reaching the desired temperature, the rolls are held at that temperature for about one-half hour and are then cooled in air. At this stage of the method, the rolls will have a very dense, tightly-adhering oxide protective layer on their working surfaces which has been found to provide significant and unexpected improvement in the wear resistance and average life of the rolls.

After cooling, the rolls are placed in a furnace and tempered at about 1025° F for about 2 hours after achieving temperature uniformity and air cooled to room temperature. The hardness of the rolls at this stage of the process is approximately 55 HRC (Hardness Rockwell "C"). The rolls are then subjected to a final tempering procedure which depends on their anticipated use in the rolling mills, for example, as breakdown rolls, intermediate rolls or finishing rolls. After the final tempering step, the rolls are cooled to room temperature in quiescent air.

Another important aspect of the invention is this final tempering step wherein the work rolls of the various stages of the rolling mill are subjected to different heat treatments to render them more suited for the particular rolling conditions encountered during rolling of the hot cast bar. The work rolls of the finishing stages, for example, are treated to provide greater hardness than either the breakdown or intermediate rolls so as to resist the abrasive wear brought about by the greater relative velocity between the bar and rolls. Conversely, the breakdown rolls are treated to a softer temper than either the intermediate or finishing rolls to provide greater toughness and resistance to thermal cracking caused by the greater temperature of the bar in the breakdown stage.

Heat treatment according to the present invention has been found to substantially improve the uniformity of useful life among the various stages of the rolling mill and the provision of the dense oxide layer on the working surfaces of the roll helps to further reduce the frequency of mill shut-down for roll replacement. A further advantage of the oxide layer, particularly with respect to the wear resistance of the finishing rolls, is that slippage between the work rolls and cast bar can be maintained at or below 5 percent.

With these and other objects, advantages and features of the invention that may become hereinafter apparent, the nature of the invention may be more clearly understood by reference to the following detailed description of the invention and to the appended claims.

DETAILED DESCRIPTION OF A PREFERRED EMBODIMENT

A work roll according to the present invention is fabricated from a forged chromium-molybdenum steel having a chromium content in the range from about 4.0 to about 6.0 weight percent and preferably from about 5.0 to about 5.5 weight percent. In a preferred embodiment, the work roll of the present invention is a steel alloy having the following composition, by weight percent: 0.35 to 0.45 carbon, 5.00 to 5.50 chromium, 0.20 to 0.50 manganese, 0.90 to 1.10 silicon, 1.20 to 1.50 molybdenum, 0.85 to 1.15 vanadium, up to 0.03 sulfur, up to 0.03 phosphorus, with the remainder iron.

In accordance with a preferred embodiment of the method of the invention, hollow bars of the forged steel roll material which have been machined to their final size, for example, 12-inch and 18-inch diameter breakdown rolls and 8-inch diameter intermediate and finishing rolls, for use in the aforementioned conventional Morgan Mill, are loaded into a preheated furnace in a manner to permit free air circulation about the working surfaces of the rolls. The rolls are heated to a temperature of about 1400° F and held for about 2 hours to insure uniform heating throughout the roll material.

After preheating, the hot rolls are loaded into a controlled atmosphere furnace, stabilized at a temperature of 1925° F, and maintained at a dew point of between about 38° F to 46° F. The preferred furnace atmosphere has a composition, on a dry basis, which comprises about 40 percent hydrogen, 20 percent carbon monoxide and 40 percent nitrogen (all percentages being volume percent). The furnace atmosphere is maintained in the aforementioned dew point range throughout the heating of the rolls. After the temperature of the rolls reaches 1925° F throughout, the rolls are held at that temperature for about ½ hour, then removed from the furnace and allowed to air cool to from about 150° F to room temperature. During cooling, the rolls are maintained in spaced, non-contacting relation to each other. If more rapid cooling is desired, the rolls may be subjected to a forced air blast to cool them to a temperature ranging from about 700° F to 750° F and then further cooled in quiescent air to about 150° F. By following the heat treatment steps as aforementioned, the work rolls are provided with a dense, tightly-adhering oxide layer which serves to protect the rolls against the temperature and pressure effects encountered in operation in the hot rolling mill.

Then the treated rolls are placed in a furnace, tempered at 1025° F for 2 hours and then cooled in air to room temperature. The hardness of the rolls at this stage of the heat treatment procedure is about 55 HRC. Thereafter, the rolls are subjected to a final tempering process which varies according to the intended use of the roll and the rolling mill. Thus, the larger diameter breakdown rolls, e.g., 18-inch diameter rolls, are heated for 2 hours at 1150° F to achieve a final surface hardness of about 43 to 46 HRC. The smaller breakdown rolls located downstream of the larger breakdown rolls, e.g., 12-inch diameter rolls, are heated for two hours at 1125° F to achieve a final surface hardness of about 45 to 49 HRC. The intermediate rolls are heated for 2 hours at 1050° F to obtain a final surface hardness of about 49 to 52 HRC, and the finishing rolls are heated for 2 hours at 1025° F to obtain a final surface hardness of 52 HRC minimum. After the final tempering, the rolls are cooled to room temperature in quiescent air.

The use of the work rolls processed according to the invention provides a rolling mill having roll stages of successively increasing hardness to counteract the effects of abrasive wear caused by the increasing velocity of the rolled bar from the initial breakdown roll stand to the final finishing roll stand and initial roll stages of greater toughness to counteract the thermal effects of the high temperature cast bar entering the rolling mill. Because each roll stage of the rolling mill is especially adapted for its particular rolling conditions according to the invention, better uniformity of life among the rolls is realized. Advantageously, therefore, when replacement of the rolls of the mill becomes necessary, generally, replacement of the rolls of all stages can be undertaken and the frequency of mill shut-down for roll replacement will be reduced.

In addition, the overall average life of all the rolls in the mill can be increased by the provision of the oxide layer formed during the heat treatment procedure. This oxide layer formed by the method of the invention is generally less than 0.001-inch thick, although greater layer thicknesses may also provide an equivalent improvement in useful life. The improved life of the roll is believed to result from the increased wear resistance of the oxide layer which is rich in $Cr_2O_3$ and in addition, from the insulating effect of the oxide layer which is believed to help reduce heat conduction of the high temperature non-ferrous bar to the roll base material and thereby substantially eliminate thermal cracking of at least the breakdown roll stages. Furthermore, the comparative coarseness of the oxide layer is believed to provide better lubricant retention than does the ground or finely polished roll surfaces of prior work rolls for non-ferrous metals. Moreover, the work rolls of the invention are not subject to the aforementioned problems during threading and start-up of hot rolling mills using polished work rolls, since the oxide layer provides increased "bite" between the hot, continuously cast bar and the work roll.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. A hot-rolling mill for hot-working of non-ferrous metals including a plurality of successively arranged roll stages comprising a breakdown roll stage, an intermediate roll stage and a finishing roll stage, the work rolls of said finishing stage having a greater hardness than the work rolls of either of said intermediate roll stage and said breakdown roll stage and the work rolls of said intermediate stage having a greater hardness than the work rolls of said breakdown stage.

2. A hot-rolling mill according to claim 1, wherein the working surfaces of the rolls have a dense, tightly-adherent oxide layer for improving the wear resistance of said rolls.

3. A hot-rolling mill according to claim 1, wherein said work rolls are formed from a forged steel alloy having a chromium content of between about 4.0 to about 6.0 percent.

4. A hot-rolling mill according to claim 3, wherein the chromium content of said steel alloy is between about 5.0 to about 5.5 percent.

5. A hot-rolling mill according to claim 4 wherein said steel alloy consists essentially of:

carbon, from about 0.35 to about 0.45 percent;
chromium, from about 5.00 to about 5.50 percent;
manganese, from about 0.20 to about 0.50 percent;
silicon, from about 0.90 to about 1.10 percent;
molybdenum, from about 1.20 to about 1.50 percent;
vanadium, from about 0.85 to about 1.15 percent;

and the remainder being iron with associated impurities.

6. A hot-rolling mill according to claim 5 wherein the hardness of said work rolls of said finishing stage is a minimum of about 52 HRC, and the hardness of said work rolls of said intermediate stage is between about 52 and about 49 HRC, and the hardness of said work rolls of said breakdown stage is between about 49 and about 43 HRC and wherein said non-ferrous metal is selected from the group consisting of aluminum alloys, copper, and copper alloys.

7. A hot-rolling mill according to claim 6 wherein said work rolls have a dense, tightly-adhesive oxide layer on at least the working surfaces of the breakdown rolls for improving the useful life thereof.

8. A hot-rolling mill according to claim 1, wherein the hardness of the finishing rolls is a minimum of 52 HRC, the hardness of the intermediate rolls is between about 52 and about 49 HRC and the hardness of the breakdown rolls is between about 49 and about 43 HRC.

* * * * *